United States Patent [19]

Bücher et al.

[11] 4,024,697

[45] May 24, 1977

[54] FALSE TWISTING MACHINE

[75] Inventors: Erich Bücher, Goppingen; Erich Scheutle, Weissenstein, both of Germany

[73] Assignee: Zinser Textilmaschinen GmbH, Ebersbach, Germany

[22] Filed: May 24, 1976

[21] Appl. No.: 688,971

[30] Foreign Application Priority Data

May 22, 1975 Germany ..... 2522601

[52] U.S. Cl. ..... 57/34 HS

[51] Int. Cl.[2] ..... D01H 13/28

[58] Field of Search ..... 57/34 R, 34 HS, 157 R, 57/157 TS, 157 MS, 106; 28/62

[56] References Cited

UNITED STATES PATENTS

| | | | |
|---|---|---|---|
| 3,165,881 | 1/1965 | Moncuit et al. | 57/34 HS |
| 3,501,904 | 3/1970 | Batsch | 57/34 HS |
| 3,813,863 | 6/1974 | Ritter | 57/34 HS |
| 3,942,312 | 3/1976 | Venot | 57/34 HS |
| 3,946,546 | 3/1976 | Venot | 57/34 HS |
| 3,962,829 | 6/1976 | Schippers | 57/34 HS |

*Primary Examiner*—Donald Watkins
*Attorney, Agent, or Firm*—Edwin E. Greigg

[57] ABSTRACT

A false twisting machine for textile yarn has a thread supply rack and a thread wind-up mechanism which are located on the base of the machine. These components, as well as the false-twisting device and the various thread draw roller mechanisms are all accessible from the base of the machine via a corridor formed between the various components. The machine also has heaters which are located above the other components and may be accessible by a separate service platform located at a higher level. Two machines may be mounted adjacent one another in a mirror symmetry.

4 Claims, 1 Drawing Figure

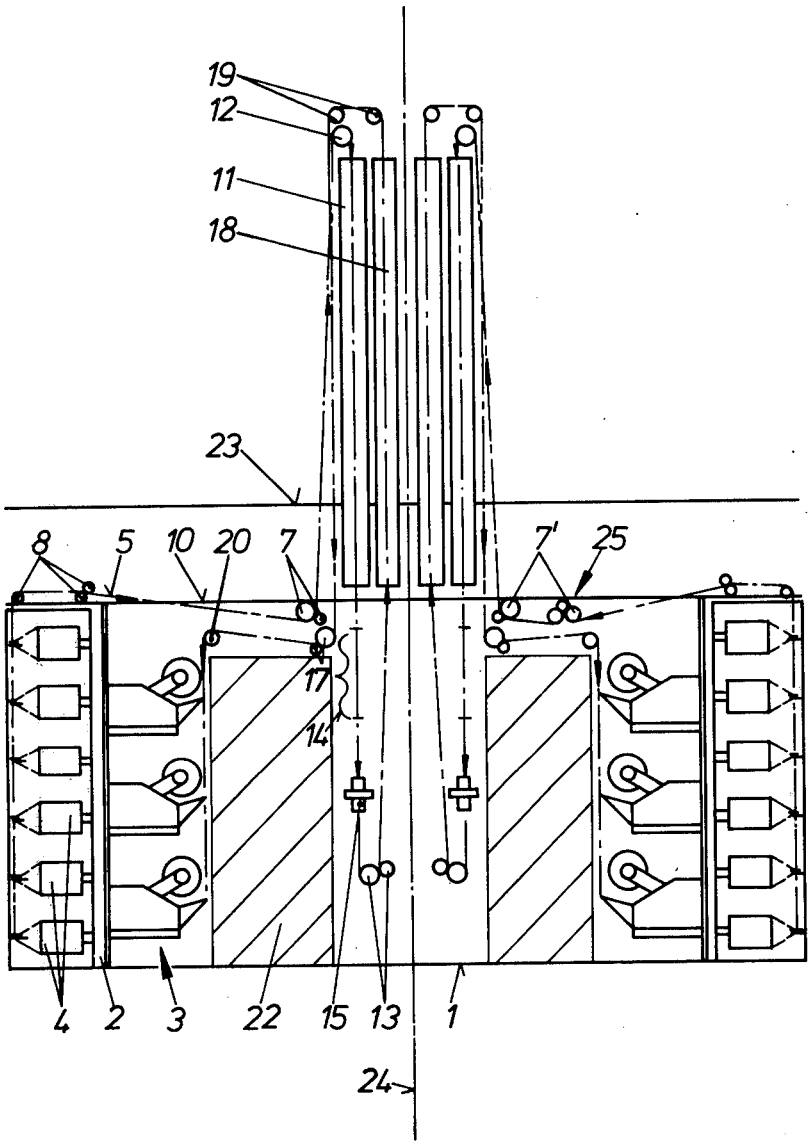
19
12
11
18
23
8
5
10
20
7
7'
25
17
14
4
2
3
22
15
13
1
24

FALSE TWISTING MACHINE

BACKGROUND OF THE INVENTION

False twisting machines generally include the following major components:

A plug-in rack which holds the supply bobbins;

A draw roller mechanism for pulling the threads from the supply bobbins and delivering them at a predetermined speed. The draw roller mechanism may include several pairs of rollers and may also be embodied as a stretching mechanism;

A first heat treatment zone in which the threads are heated up to their softening temperature;

A cooling zone in which the previously heated threads are cooled down again;

A false twisting device which imparts to the threads a false twist whose rotation extends into the heat treatment zone;

A second draw roller mechanism for transporting the threads through the first heat treatment zone and through the false twisting device at a predetermined tension which is substantially responsible for the type of thread produced;

A second heat treatment zone in which the previously treated threads are now subjected to a further heat treatment;

A third draw roller mechanism which guides the threads at a predetermined tension through the second heat treatment zone; and A wind-up mechanism for winding the threads on spools.

The spooling mechanisms generally are disposed on several levels.

The sequential disposition of these various mechanisms during the treatment of the thread by the above-described method is generally more or less fixed; however, the spatial location of these components is subject to choice. For this reason, there is known a great variety of different spatial configurations of the various components of a false twisting machine but all of these different configurations have distinct disadvantages.

The conditions which machines of this type must obey are, among others, the following: The various components must be accessible to service personnel. If the components are all located on a single level so as to be serviceable from that level, they require a great deal of room both in length and width and, furthermore, the path of the thread is very long and unfavorable. For this reason, it is customary to build vertically and to provide a second service level. This configuration, however, considerably increases the movements of the service personnel unless those components which require service and exchange more frequently are so disposed as to be serviceable from a single level. For example, it is a disadvantage to locate plug-in racks and spooling mechanisms one on top of the other because the transport of the heavy filled-up bobbins and spools through vertical distances is cumbersome and requires the expenditure of strength. It is also disadvantageous to dispose components of the machine on top of heat treatment zones because the rising heat from those zones has disadvantageous effects. Further, it is disadvantageous to locate the two heat treatment zones vertically superimposed because they are usually quite long and the entire apparatus then acquires excessive vertical height or the cooling zone no longer has sufficient space. It is also disadvantageous to dispose the heat treatment zones horizontally because in that case the substantial heat rising from the zones represents a considerable energy loss and causes undesirable heating of the surrounding space.

OBJECT AND SUMMARY OF THE INVENTION

It is thus a principal object of the present invention to provide a false twisting machine in which the various components are located and disposed in a manner permitting satisfactory accessibility by service personnel. It is a further object of the invention to provide a false twisting machine in which the spatial disposition of components is such that they exert the least possible interferce, one upon the other. Yet another advantage of the invention is to provide a false twisting machine with as short a thread path as possible and simple introduction of the thread into the machine. Yet another advantage of the invention is that the machine requires short service paths and the transport of heavy spools is required only on the main service level.

Due to the novel and advantageous configuration of the components of the false twisting machine according to the present invention, plug-in racks, wind-up mechanisms, draw roller mechanisms and false twisting devices can all be serviced from the main service level. The heat treatment zones only require very occasional service and the threading of the fiber into these zones may take place by known mechanisms from the main service level. The two heat treatment zones are joined and thereby reduce the heat loss to a minimum. No further components are placed vertically above the heat treatment zones so that any rising warm air or gases cannot have a deleterious effect. It is possible, depending on the required running speed of the thread and the type of threads to be treated, to provide heat treatment zones of different length without otherwise changing the configuration of the machine. The component requiring the most intricate service, namely the false twisting device, may be positioned so as to be most easily accessible at the most advantageous height.

In a further preferred embodiment of the invention, the space between the wind-up mechanism and the first and third draw roller mechanisms as well as the space between the false twisting device and the second draw roller mechanism are accessible to service personnel. In this embodiment of the false twisting machine, all important components are accessible to service personnel. In order to make the heat treatment zones accessible to service, another embodiment of the invention provides an intermediate service level above the main mechanical components of the machine at the approximate level of the heat treatment zones.

Yet another embodiment of the invention provides that two false twisting machines according to the invention are juxtaposed in mirror symmetry resulting in a particularly advantageous space saving and economical positioning of all parts of the machine.

The invention will be better understood as well as further objects and advantages thereof become more apparent from the ensuing detailed description of preferred embodiments taken in conjunction with the drawing.

BRIEF DESCRIPTION OF THE DRAWING

The single FIGURE of the drawing is a schematic vertical section through a false twisting machine according to the invention. The primary preferred embodiment of the machine is illustrated in the left half of the figure.

DESCRIPTION OF THE PREFERRED EMBODIMENTS

Turning now to the single FIGURE, there is illustrated a false twisting machine according to the invention in an embodiment showing substantially two machines juxtaposed in mirror image symmetry. The primary embodiment of the invention will be explained with respect to the false twisting machine illustrated in the left half of the figure. The machine has a base plate 1 on which there is located a plug-in rack 2 holding a plurality of supply bobbins 4 on several levels and adjacent thereto a wind-up spooling mechanism 3. A first draw roller mechanism 7 pulls threads 5 from the supply bobbins 4 and, during their passage, they are turned by guide rollers 8. The location of the first draw roller mechanism 7 is such as to lie above the wind-up spooling mechanism 3 and below an intermediate level 10. Located above the intermediate level 10 is a first heat treatment zone 11, for example a hot plate, which is traversed by the threads 5 coming from the first draw roller mechanism 7 which are pulled by a second draw roller mechanism 13 and passed through further guide rollers 12. Subsequent to the heat treatment of the threads 5 in the heat treatment zone 11, the threads are cooled in a cooling zone 14 provided for cooling of the threads between the heat treatment zone 11 and a draw twisting device 15. The cooling zone and the draw twisting device 15 both lie beneath the intermediate level 10. The cooling zone 14, the false twisting device 15 and the second draw roller mechanism 13 are all located above the base plate 1 at a height permitting a favorable accessibility by service personnel. A third draw roller mechanism 17 disposed just beneath the intermediate level 10 and below the first draw roller mechanism 7, pulls the threads 5 from the second draw roller mechanism 13 through a second heat treatment zone 18 located above the intermediate level 10 and adjacent to the first heat treatment zone 11. The thread passes over guide rollers 19 and 20 and is delivered to the spools of the wind-up mechanism 3 on several levels for the purpose of spooling.

The above-described disposition of the components of the false twisting machine according to the invention creates a free space between the wind-up mechanism 3 and the false twisting device 15, and between the second draw roller mechanism 13 and the first and second draw rollers 7 and 17 located thereabove. This space is shaded in the drawing and is embodied as a service corridor 22. Thus, all important components of the false twisting machine which require constant attention and frequent service are accessible from the main service level, i.e., especially from the service corridor. They are thus always accessible and easy to service and to repair.

The less frequent service and repair of the first and second heat treatment zones 11 and 18 is insured by the provision of an intermediate level 10 on which there is located a service platform 23.

The right half of the figure shows an almost identical false twisting machine disposed in mirror image configuration with the machine illustrated in the left half of the figure. The symmetry plane for these two machines is labeled 24. The mirror image disposition creates a particularly compact and space-saving arrangement. The machine illustrated in the right half of the figure further includes a fourth set of delivery rollers 25. If the delivery speeds of the sets of rollers 7' and 25 are suitably chosen, the thread 5 may be subjected to stretching between these two sets of rollers.

The spatial disposition of the components of the false twisting machine described above according to the invention, as well as their mutual orientation, can also be used for any and all of a plurality of adjacent false twisting mechanisms within a large false twisting machine assembly.

The foregoing pertains to preferred embodiments of the invention and many variants and further embodiments thereof are possible within the spirit and scope of the invention, the latter being defined by the appended claims.

What is claimed is:

1. A false twisting machine for textile fibers, including a base, a frame and a set of components comprising:

a supply bobbin rack, mounted on said base;

wind up spool means, located on said base adjacent to said supply bobbin rack;

first draw roller means, located on said frame above said wind up spool means, for pulling thread from the bobbins on said supply bobbin rack;

first heater means, located above said first draw roller means;

false twisting means, located on said frame below said first heater means, and defining a thread cooling zone therewith;

second draw roller means, located on said frame below said false twisting means, for pulling thread through said first heater means and through said false twisting means;

second heater means, located above said first draw roller means and adjacent said first heater means; and third draw roller means, located on said frame above said wind-up spool means, for pulling thread through said second heater means and for guiding it to said windup spool means.

2. A false twisting machine as defined by claim 1, wherein the enclosed space jointly defined by said wind-up spool means, said first and third draw roller means, said false twisting means and said second draw roller means is a passage for providing access for servicing said wind-up spool means, said first, second and third draw roller means and said false twisting means.

3. A false twisting machine as defined by claim 1, further comprising a service platform mounted on said machine above said wind-up spool means.

4. A false twisting machine as defined by claim 1 including a second set of components substantially identical to said set of components and disposed on said base in mirror symmetry to said set of components; whereby respective heater means in said set of components and said second set of components are adjacent.

* * * * *